United States Patent [19]

Barton

[11] 4,124,522

[45] Nov. 7, 1978

[54] METHOD FOR CLEANING MOUTHPIECE OF SMOKING ARTICLE

[76] Inventor: Boyd O. Barton, 13 Bellerive, Springfield, Ill. 62704

[21] Appl. No.: 773,612

[22] Filed: Mar. 2, 1977

[51] Int. Cl.[2] ..... C11D 7/26; C11D 7/12; B08B 3/08

[52] U.S. Cl. ..... 252/142; 134/42; 252/89 R

[58] Field of Search ..... 252/89, 142, 100; 134/41, 42, 3; 131/243, 244, 245

[56] References Cited

U.S. PATENT DOCUMENTS

| | | | |
|---|---|---|---|
| 3,337,466 | 8/1967 | Puetzer et al. | 252/99 |
| 3,526,600 | 9/1970 | Shamsi | 252/89 |
| 3,607,759 | 9/1971 | Barth | 252/99 X |
| 3,640,879 | 2/1972 | Fitzgerald | 252/100 X |
| 3,997,459 | 12/1976 | Bogie et al. | 252/142 X |

*Primary Examiner*—Harris A. Pitlick
*Attorney, Agent, or Firm*—Grace J. Fishel

[57] ABSTRACT

A method for cleaning tobacco stains from a pipe stem or a cigar or cigarette holder wherein a particularly effective cleaning solution is prepared, applied to the stain and wiped away removing the stain without harming the finish of the stem or holder, said effective cleaning solution being an aqueous mixture of a carboxylic acid selected from the group consisting of saturated hydroxycarboxylic acids and saturated polycarboxylic acids or salts thereof and an alkali carbonate.

3 Claims, No Drawings

METHOD FOR CLEANING MOUTHPIECE OF SMOKING ARTICLE

This invention relates to a method for cleaning the mouthpiece of smoking articles such as pipe stems and cigar and cigarette holders.

Most mouthpieces of pipe stems and holders are formed from plastic and are shiny when new. With use, such mouthpieces usually become stained and lose their shiny appearance. This occurs through the deposit of alkaloids and other insoluble materials normally found in tobacco smoke.

Such deposits are not readily cleaned away. Some smokers scrape them off with a knife or sand them off with a buffing wheel. Since most mouthpieces, as above mentioned, are formed from plastic such treatment scratches the plastic and destroys its polished finish.

Chemical mixtures have also been used to remove tobacco stains but these, insofar as known, have not been very effective. Moreover, some of them, such as that described in U.S. Pat. No. 3,526,600 also suffer from the same shortcomings as scraping or sanding.

For example, the treatment described in the above-mentioned patent makes use of diatomaceous earth which, like a knife or a sanding wheel, is an abrasive. When a mouthpiece is cleaned by this method, it is also roughened. Once roughened, the surface is diminished in beauty and seems to stain more easily.

In view of the above, there is a need for a method of cleaning which is effective and which is not harmful to the finish of the mouthpiece. Preferably, such a method would utilize readily available, non-toxic materials and would be easy to apply.

Accordingly, it is an object of the present invention to provide a chemical treatment for cleaning stains from the mouthpiece of smoking articles. Another object is to provide a chemical treatment which makes use of non-toxic materials, which is easy to apply and which is highly effective. It is still another object to provide a chemical treatment which does not mar the plastic finish of the mouthpiece. Other objects and features will be in part apparent and in part pointed out hereinafter.

The invention accordingly comprises the methods hereinafter described, the scope of the invention being indicated in the subjoined claims.

In accordance with the present invention, a cleaning solution for a smoker's mouthpiece is formed by admixing a carboxylic acid or salts thereof with an alkali carbonate. Suitable carboxylic acids include the saturated hydroxycarboxylic acids and the saturated polycarboxylic acids, said acids preferably having between 2 and 8 carbon atoms and more preferably between 4 and 6. Suitable salts thereof include the alkali salts such as those of sodium and potassium.

To be useful herein, said carboxylic acids or their salts must be water soluble and relatively non-toxic. That is, they must not be harmful to the user's hands or leave a physiologically harmful residue on the mouthpiece. For this purpose, it has been found that citric acid, tartaric acid, succinic acid and lactic acid or their sodium salts are particularly useful. Of these acids, tartaric acid is more effective than citric acid and both are more effective than the other two. Furthermore, in general, the salts are less effective than the carboxylic acids from which they are derived. Adipic acid has also been found useful, albeit less so because of its limited solubility in water.

In general, polyhydroxypolycarboxylic acids such as tartaric acid are more effective than monohydroxypolycarboxylic acids such as citric acid. Similarly, in general, these acids are more effective than the polycarboxylic acids such as succinic acid. The monohydroxymonocarboxylic acids such as lactic acid, to be useful herein, are preferably used in combination with some other carboxylic acid. One suitable mixture, for example, is that of lactic and citric acids.

Particularly preferred are combinations of said carboxylic acids such as that of citric and malic acids naturally occuring in lemon juice, mixtures of citric and tartaric acids, mixtures of citric and lactic acids or the like. Such mixtures have been found more effective perhaps because of chemical differences in the composition of the tobacco stain, one carboxylic acid being more effective than another for particular components thereof. The most effective combination, for reasons not fully understood, found up to now is that of tartaric and citric acids.

Suitable alkali carbonates for use in accordance with the present invention include those of sodium and potassium. Particularly preferred is sodium bicarbonate, sodium carbonate being less effective and hence less preferred.

Once a carboxylic acid or its salt, or mixtures thereof, and an alkali carbonate, or mixtures thereof, have been selected, the cleaning solution is prepared by combining said materials in water. Usually, said materials are separately dissolved in water at room temperature and then combined. To prevent excessive foaming, particularly when the alkali carbonate is sodium, it is preferred that the bifunctional carboxylic acid be added to the sodium.

When the cleaner has been made up, it is relatively shelf stable and may be prepared long before it is ready for use. If foaming is a desired feature, the mixture may be freshly prepared at the time of use. While the foaming mixture does not seem to be any more effective than one made in advance, it may appear more efficacious to the user and, for that reason, be preferred.

While the concentrations and the proportions of the carboxylic acid or its salt and the alkali carbonate are not highly critical, it is preferred that the mixture be formed as a solution wherein the carbonate is greatly in excess, preferably in such excess that the cleaner is a paste. To this solution, the carboxylic acid or its salt is preferably added as an aqueous solution.

In general, it has been found that the more concentrated the acid solution, the more effective is the cleaner, still leaving, preferably however, an excess of the alkali carbonate. Effective cleaners, for example, have been formed by combining an aqueous paste of sodium bicarbonate and a carboxylic acid wherein the acid concentration added to the cleaner varies from about 1 to about 40 percent by weight/volume.

In use, the cleaner is applied directly to the tobacco stain or indirectly to a cloth and then to the stain. The wetted stain can then be immediately wiped away. Successive treatments, if necessary, can be applied until the mouthpiece is clean. Once the mouthpiece has been restored to a clean condition, it has been found that subsequent cleanings are accomplished even more readily.

Since the carboxylic acids or salts thereof and the alkali carbonates are not harmful to the user's hands, the smoker may apply the treatment without wearing gloves. Moreover, it is not necessary that the cleaner be completely wiped off the mouthpiece since it is not harmful to the smoker in the amount likely to be ingested.

Percentages throughout the following examples, which illustrate the invention, are expressed in percent by weight/volume. Where citric acid is present in the formula, percentages are based on the dihydrate. Percentages of the other acids or their salts where commonly available as a hydrate are similarly based on the hydrate.

EXAMPLE 1

Three cleaning solutions as described in Table 1 were prepared as follows: Sufficient sodium bicarbonate was added to water to make a thin paste. To this paste was added the remainder of the ingredients.

Table 1

| Ingredient | Cleaner 1 | Cleaner 2 | Cleaner 3 |
|---|---|---|---|
| Sodium bicarbonate | paste | paste | paste |
| Citric acid | 7.0% | 7.0% | — |
| Malic acid | 0.5% | — | — |
| Sucrose | 0.5% | — | — |
| Dextrose | 1.0% | — | — |
| Pectin | 0.4% | — | — |
| EDTA[1] | — | — | 7.0% |

[1]ethylenediaminetetraacetic acid

Each of the above described cleaners was tested for effectiveness as a pipe stem cleaner. Cleaners 1 and 2 were found effective but Cleaner 3 was not.

Cleaner 3 is not an embodiment of the present invention but was prepared for the purpose of comparison with Cleaners 1 and 2 which are. From this comparison, it is seen that only certain sequestrating agents are effective in cleaners according to the present invention.

The materials added to the sodium bicarbonate in Cleaner 1 were selected to duplicate the composition of lemon juice.

EXAMPLE 2

Following the procedure of Example 1, four cleaning solutions as described in Table 2 were prepared.

Table 2

| Ingredient | Cleaner 4 | Cleaner 5 | Cleaner 6 | Cleaner 7 |
|---|---|---|---|---|
| Sodium bicarbonate | paste | paste | paste | paste |
| Citric acid | 2.0% | 7.0% | 20.0% | — |
| Sodium citrate | — | — | — | 10.0% |

Each of the above-described cleaners was tested as before. All were found effective and are embodiments useful in the present invention. Cleaner 7, however, was not as effective as the other cleaners. In general, Cleaners 4, 5 and 6 were increasingly effective with increasing citric acid concentration. Occasional reverses in effectiveness were observed in testing, however, primarily because of the subjective nature of the test and because of differences in the composition of the tobacco stain and differences in the composition and surface condition of the pipe stem being cleaned.

EXAMPLE 3

Following the procedure of Example 1, three cleaning solutions as described in Table 3 were prepared.

Table 3

| Ingredient | Cleaner 8 | Cleaner 9 | Cleaner 10 |
|---|---|---|---|
| Sodium bicarbonate | paste | paste | paste |

Table 3-continued

| Ingredient | Cleaner 8 | Cleaner 9 | Cleaner 10 |
|---|---|---|---|
| Citric acid | 4.0% | — | — |
| Succinic acid | — | 4.0% | — |
| Tartaric acid | — | — | 5.0% |

Each of the above-described cleaners was tested and found effective. The acid in each cleaner was present in an equal molar amount.

EXAMPLE 4

Following the procedure of Example 1, four cleaning solutions as described in Table 4 were prepared.

Table 4

| Ingredient | Cleaner 11 | Cleaner 12 | Cleaner 13 | Cleaner 14 |
|---|---|---|---|---|
| Sodium bicarbonate | paste | paste | paste | paste |
| Citric acid | 4.0% | 7.0% | 10.0% | 13.0% |

Each of the above-described cleaners was found effective when it was tested. In general, the cleaners were increasingly effective with increasing amounts of citric acid.

EXAMPLE 5

Following the procedure of Example 1, two cleaning solutions as described in Table 5 were prepared.

Table 5

| Ingredient | Cleaner 15 | Cleaner 16 |
|---|---|---|
| Sodium bicarbonate | paste | paste |
| Sodium citrate | 10.0% | — |
| Sodium acetate | — | 4.6% |

When the above-described cleaners were tested, only Cleaner 15 was effective. Cleaner 16 is not an embodiment of the present invention but was prepared for purposes of comparison.

EXAMPLE 6

A cleaning solution 17 was prepared as follows: Sufficient sodium bicarbonate was added to water so that the resultant cleaner contained 16.0%. To this solution was added citric acid in an amount so that the cleaner contained 7.0%.

When cleaner 17 was tested, it was found effective but less so than Cleaner 2 wherein the sodium bicarbonate was present in a greater excess.

EXAMPLE 7

Following the procedure of Example 1, five cleaning solutions as described in Table 6 were prepared. Where sodium carbonate was not present in the formula, the indicated alkali salt was used.

Table 6

| Ingredient | Cleaner 18 | Cleaner 19 | Cleaner 20 | Cleaner 21 | Cleaner 22 |
|---|---|---|---|---|---|
| Sodium bicarbonate | paste | — | — | — | — |
| Sodium carbonate | — | paste | — | — | — |
| Sodium acetate | — | — | paste | — | — |
| Sodium chloride | — | — | — | paste | — |
| Sodium citrate | — | — | — | — | paste |
| Citric acid | 7.0% | 7.0% | 7.0% | 7.0% | 7.0% |

Each of the above-described cleaners was tested but only Cleaners 18 and 19 were found effective, Cleaner 19 being much less so than Cleaner 18. The other cleaners are not embodiments useful in the present invention but were prepared for the purpose of comparison. Cleaners 20, 21 and 22 illustrate, in comparison to Cleaners 18 and 19, that alkali carbonates are essential.

EXAMPLE 8

Following the procedure of Example 1, six cleaning solutions as described in Table 7 were prepared.

Table 7

| Ingredient | Cleaner 23 | 24 | 25 | 26 | 27 | 28 |
|---|---|---|---|---|---|---|
| Sodium bicarbonate | paste | paste | paste | paste | paste | paste |
| Adipic acid | 1.0% | — | — | — | — | — |
| Tartaric acid | — | 5.0% | — | — | — | — |
| Citric acid | — | — | 2.0% | — | — | — |
| Succinic acid | — | — | — | 4.0% | — | — |
| Benzoic acid | — | — | — | — | Saturated | — |
| Stearic acid | — | — | — | — | — | Saturated |

Each of the above cleaners was tested and all were effective except Cleaners 27 and 28. Cleaners 27 and 28 are not embodiments useful in the present invention and were prepared for purposes of comparison only.

EXAMPLE 9

Following the procedure of Example 1, six cleaning solutions as described in Table 8 were prepared.

Table 8

| Ingredient | Cleaner 29 | 30 | 31 | 32 | 33 | 34 |
|---|---|---|---|---|---|---|
| Sodium bicarbonate | paste | paste | paste | paste | paste | paste |
| Citric acid | 7.0% | — | — | 7.0% | — | — |
| Succinic acid | — | 4.0% | — | — | 4.0% | — |
| Tartaric acid | — | — | 5.0% | — | — | 5.0% |

Each of the above cleaners was labeled with numbers only and tested by two researchers, X and Y. Each researcher graded the cleaners as to effectiveness. The results are reported in Table 9.

Table 9

| Cleaner | Rating[2] X | Y |
|---|---|---|
| 29 | 3 | 2 |
| 30 | 3 | 3 |
| 31 | 1 | 1 |
| 32 | 2 | 3 |
| 33 | 4 | 2 |
| 34 | 3 | 1 |

[2]The rating scale was 1–10 with number 1 indicating that the cleaner was highly effective, number 10 indicating that it was ineffective.

The ratings given by researcher Y were consistent while those of researcher X were not. Both researchers, however, found that tartaric acid is most effective and that all were effective in some degree.

EXAMPLE 10

Following the procedure of Example 1, six cleaning solutions as described in Table 10 were prepared.

Table 10

| Ingredient | Cleaner 35 | 36 | 37 | 38 | 39 | 40 |
|---|---|---|---|---|---|---|
| Sodium bicarbonate | paste | paste | paste | paste | paste | paste |
| Tartaric acid | 2.0% | 5.0% | 12.0% | — | — | 5.0% |
| Citric acid | — | — | — | 7.0% | 14.0% | 7.% |

Each of the above cleaners was tested by researchers X and Y as described in Example 9. The results are reported in Table 11.

Table 11

| Cleaner | Rating X | Y |
|---|---|---|
| 35 | 5 | 4 |
| 36 | 5 | 4 |
| 37 | 1 | 2 |
| 38 | 4 | 3 |
| 39 | 3 | 3 |
| 40 | 1 | 1 |

As before, both X and Y found all of the cleaners effective. Both found Cleaner 40 most effective. This cleaner contained a mixture of citric and tartaric acids.

EXAMPLE 11

Following the procedure of Example 1, six cleaning solutions as described in Table 12 were prepared.

Table 12

| Ingredient | Cleaner 41 | 42 | 43 | 44 | 45 | 46 |
|---|---|---|---|---|---|---|
| Sodium bicarbonate | paste | paste | paste | paste | paste | paste |
| Citric acid | 14.0% | — | 7.0% | — | — | 7.0% |
| Tartaric acid | — | 12.0% | 5.0% | — | — | — |
| Lactic acid | — | — | — | 3.4% | 6.8% | 3.4% |

As described in the previous examples, each of the above cleaners was tested by researchers X and Y. The results are reported in Table 13.

Table 13

| Cleaner | Rating X | Y |
|---|---|---|
| 41 | 3 | 3 |
| 42 | 5 | 4 |
| 43 | 1 | 1 |
| 44 | 5 | 5 |
| 45 | 5 | 6 |
| 46 | 2 | 2 |

All of the solutions were found effective by both researchers. Cleaner 43 which contained a mixture of citric and tartaric acids was, as in Example 10, rated highest. Cleaners 44 and 45 with lactic acid alone were rated low but Cleaner 46 with a combination of lactic and citric acid was rated highly.

In view of the above, it will be seen that the several objects of the invention are achieved and other advantageous results attained. As various changes could be made in the above methods without departing from the scope of the invention, it is intended that all matter contained in the above description shall be interpreted as illustrative and not in a limiting sense.

What is claimed is:

1. A method for cleaning a mouthpiece of a smoking article comprising the steps of:

(a) forming an aqueous mixture of citric acid and tartaric acid or lactic acid or salts thereof and sodium bicarbonate;

(b) applying said aqueous mixture to a tobacco stain on the mouthpiece; and, (c) removing said aqueous mixture whereby the stain is removed and the finish of the mouthpiece preserved.

2. The method according to claim 1 wherein the amount of sodium bicarbonate exceeds the amount of carboxylic acid present as citric acid and tartaric acid or lactic acid or as salts thereof.

3. The method according to claim 2 wherein the sodium bicarbonate is present in an amount such that the mixture is a paste and the carboxylic acid is a mixture of citric acid and tartaric acid and is present in an amount from about 1 to about 40% by weight/volume.

* * * * *

UNITED STATES PATENT AND TRADEMARK OFFICE

CERTIFICATE OF CORRECTION

PATENT NO. : 4,124,522

DATED : November 7, 1978

INVENTOR(S) : Boyd O. Barton

It is certified that error appears in the above–identified patent and that said Letters Patent are hereby corrected as shown below:

Column 2, line 32, insert the word "bicarbonate" after the word "sodium".

Column 2, line 33, delete the word "bifunctional".

Column 2, line 33, insert the word "bicarbonate" after the word "sodium".

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*